US008572916B2

(12) United States Patent
D'Avela

(10) Patent No.: US 8,572,916 B2
(45) Date of Patent: Nov. 5, 2013

(54) MASONRY UNIT SYSTEMS AND METHODS

(75) Inventor: Canan D'Avela, Yuma, AZ (US)

(73) Assignee: Concrete Products Group LLC, North Hamel, MN (US)

( * ) Notice: Subject to any disclaimer, the term of this patent is extended or adjusted under 35 U.S.C. 154(b) by 76 days.

(21) Appl. No.: 13/312,831

(22) Filed: Jan. 4, 2012

(65) Prior Publication Data

US 2013/0167460 A1 Jul. 4, 2013

Related U.S. Application Data

(63) Continuation-in-part of application No. 29/408,054, filed on Dec. 6, 2011, now Pat. No. Des. 673,301, and a continuation-in-part of application No. 29/408,061, filed on Dec. 6, 2011, now Pat. No. Des. 673,302, and a continuation-in-part of application No. 29/408,071, filed on Dec. 6, 2011, now Pat. No. Des. 673,303, and a continuation-in-part of application No. 29/408,073, filed on Dec. 6, 2011, now Pat. No. Des. 673,304.

(51) Int. Cl.
*E04C 1/39* (2006.01)

(52) U.S. Cl.
USPC ..... 52/302.1; 52/169.5; 52/284; 52/286

(58) Field of Classification Search
USPC ..... 52/169.5, 302.1, 302.3, 284, 286, 503, 52/505
See application file for complete search history.

(56) References Cited

U.S. PATENT DOCUMENTS

| | | | | |
|---|---|---|---|---|
| 1,771,275 | A * | 7/1930 | Stamm | 138/115 |
| 3,568,391 | A * | 3/1971 | Conway | 52/586.2 |
| 3,650,079 | A * | 3/1972 | Lubin | 52/316 |
| 3,888,060 | A * | 6/1975 | Haener | 52/284 |
| 4,640,071 | A * | 2/1987 | Haener | 52/286 |
| 5,115,614 | A | 5/1992 | McGrath | |
| 5,226,272 | A * | 7/1993 | Sauve | 52/169.5 |
| 6,065,265 | A * | 5/2000 | Stenekes | 52/607 |
| 8,099,918 | B2 * | 1/2012 | Marsh et al. | 52/285.2 |
| 2009/0183445 | A1 * | 7/2009 | McPherson | 52/169.5 |
| 2010/0242390 | A1 * | 9/2010 | Lee Lum | 52/302.1 |
| 2012/0060433 | A1 * | 3/2012 | Chandler | 52/169.5 |

OTHER PUBLICATIONS

"Integral Flashing System" (publicly available before Dec. 6, 2011), 4 pages.
"A Simple Solution to Through-Wall Flashing" (publicly available before Dec. 6, 2011), 2 pages.
"Flashing Strategies for Concrete Masonry Walls," TEK 19-4A (2008), 4 pages.
"Flashing Details for Concrete Masonry Walls," TEK 19-5A (2008), 6 pages.
"Characteristics of Concrete Masonry Units with Integral Water Repellent," TEK 19-7 (2008), 6 pages.

(Continued)

*Primary Examiner* — William Gilbert
*Assistant Examiner* — Alp Akbasli
(74) *Attorney, Agent, or Firm* — Fish & Richardson P.C.

(57) ABSTRACT

Some embodiments of masonry blocks can be used to form a wall system that provides an improved resistance to moisture penetration that might otherwise advance to an interior surface of the wall. In particular embodiments, some or all of the masonry blocks in the wall system may be equipped with one or more moisture drainage elements formed in a surface of the respective masonry block.

19 Claims, 10 Drawing Sheets

(56) References Cited

OTHER PUBLICATIONS

"Precision Block," RCP Block & Brick (publicly available before Dec. 6, 2011), 4 pages.
"Design for Dry Single-Wythe Concrete Masonry Walls," TEK 19-2A (2008), 4 pages.
"Concrete Masonry Units Size and Shape Guide" (publicly available before Dec. 6, 2011), 8 pages.
"ASTM Specifications for Concrete Masonry Units," TEK 1-1E (2007), 4 pages.
"Concrete Block Sizes and Shapes," Allied Concrete Co. (publicly available before Dec. 6, 2011), 12 pages.
"Shapes & Sizes Directory," Superlite Block (publicly available before Dec. 6, 2011), 72 pages.
"Quik>Brik Brochure" (2007), 2 pages.

* cited by examiner

MASONRY UNIT SYSTEMS AND METHODS

CROSS-REFERENCE TO RELATED APPLICATIONS

This is a continuation-in-part of: U.S. patent application Ser. No. 29/408,054 filed on Dec. 6, 2011; U.S. patent application Ser. No. 29/408,061 filed on Dec. 6, 2011; U.S. patent application Ser. No. 29/408,071 filed on Dec. 6, 2011; and U.S. patent application Ser. No. 29/408,073 filed on Dec. 6, 2011.

TECHNICAL FIELD

This document relates to building materials, such as one or more masonry units for use in designing and constructing a wall.

BACKGROUND

The construction of buildings and other structures may often employ concrete masonry building materials, such as masonry units (commonly referred to as masonry blocks). For example, an individual masonry wall assembly may be constructed using either a single vertical section of masonry units (known as a "wythe") or adjacent cavity wall vertical sections (known as a "double wythe" or "multiwythe").

During the construction of some building structures, a set of masonry wall assemblies can be used to provide a building envelope that defines a number of exterior walls of the building structure. In such circumstances, multiwythe masonry walls are commonly employed in an effort to resist the penetration of water or other moisture to the interior of a building. For example, double wythe masonry walls usually provide an interior vertical void or cavity between an exterior vertical section and an interior vertical section of the masonry wall, thereby in part creating a drainage path for water or other moisture that penetrates through the exterior vertical section and thus reducing the likelihood that the water will pass to the interior of the building.

These double wythe masonry walls, however, are usually more costly (in both materials and labor) than single wythe masonry walls because the interior vertical section can serve as the structural wall while the exterior vertical section is erected to serve as a veneer. Conversely, a single wythe masonry wall may employ only a single vertical section of masonry units, but (depending on a number of factors) the single wythe masonry wall might be less effective at resisting moisture penetration as compared to the more costly double wythe masonry wall.

Other supplemental techniques may be implemented during the design and construction of a masonry wall in an effort to reduce the likelihood of moisture penetration through the wall. For example, the use integral water repellent admixtures in the masonry block compositions and in the mortar materials, as well as the use of concave joints when finishing the mortar and grout may contribute to moisture control. Also, the use of flashing at all horizontal interruptions of the wall surface or the use of drainage cores in the wall may contribute to moisture control. Another option to supplement the masonry wall is for a builder to apply breathable penetrating sealants or coatings on the installed wall surface, and to install drainable "weeps" at the base of the wall to facilitate the redirection of accumulated moisture in the wall cavity or masonry unit cores to the exterior. Other conventional efforts to reduce the likelihood of moisture penetration include applying air/moisture barriers along the wall, using condensation control techniques at any areas where thermal bridges in the wall may be present, and using joint reinforcement and movement joints to reduce the likelihood of cracking along the masonry wall.

While these supplemental techniques can be useful, some masonry walls are not always designed constructed using these techniques, or the workers constructing the masonry wall do not always implement these techniques in a consistent manner. Accordingly, if these supplemental techniques are overlooked or not satisfactorily executed at the construction site, the ability of the masonry wall to resist moisture penetration can be compromised.

SUMMARY

Some embodiments of masonry units can be used to form a wall that provides an improved resistance to moisture penetration that might otherwise advance to an interior surface of the wall. Moreover, in particular embodiments, the wall formed of the masonry units can provide a highly effective moisture penetration resistance even when other supplemental moisture control techniques are not implemented or not properly executed at the construction site. In some embodiments, the masonry units described herein may provide a standard size and form factor such that the masonry units may not require special installation techniques other than those commonly used in the industry, but the masonry units described herein may be equipped with one or more moisture drainage elements formed in a surface of each masonry unit. In such circumstances, the moisture drainage elements can be arranged between an exterior face of the masonry wall and an interior face of the masonry wall so as to provide a drainage path for water or other moisture that migrates from the exterior face toward the interior face. In one example, some of all the masonry units may include one or more moisture drainage elements integrally formed along on the respective unit's top surface so that, when the units are assembled into a wall structure, the moisture drainage elements are configured to divert water to drain vertically through a corresponding interior hollow core of the respective masonry unit, thereby permitting the water to drain vertically through an interior core of the masonry wall rather than migrating toward the interior face of the masonry wall.

Particular embodiments described herein may include a masonry wall system. The masonry wall system may include a first row of masonry blocks (also referred to herein as masonry units), and a second row of masonry blocks positioned vertically over the first row of masonry blocks so as to provide vertical wall section having an exterior face and an interior face. Each masonry block of the first row of masonry blocks may include a top surface oriented toward the second row of masonry blocks and a bottom surface opposite from the top surface. Furthermore, each masonry block of the first row of masonry blocks may include includes at least one moisture drainage element arranged along the top surface of the respective masonry block. The moisture drainage element may include at least one downwardly slanted surface extending toward an interior hollow core of the respective masonry block. Optionally, the moisture drainage element may be spaced inwardly from an outer rim of the top surface of the respective masonry block such that the entire outer rim of the top surface of the respective masonry block has a generally continuous height relative to the bottom surface of the of the respective masonry block.

Some embodiments described herein may include a masonry unit for use in a wall system. The masonry unit may include a front face and a rear face, and a vertical height of the rear face may be substantially equal to a vertical height of the front face. The masonry unit may also include a plurality of web portions extending between the front and rear faces to define one or more interior hollow cores. Optionally, each of the web portions may extend generally perpendicularly to the front and rear faces, and may have a vertical height that is substantially equal to the vertical height of the front face. The masonry unit may further include a liquid diversion element arranged along a top surface of each web portion extending between the front and rear faces. Optionally, the liquid diversion element may include at least one downwardly slanted surface extending toward at least one of the interior hollow cores.

Other embodiments described herein may include a method of controlling moisture penetration through a masonry wall. The method may include receiving water or other moisture along a top surface of a masonry block in a masonry wall. The moisture may advance along the top surface from an exterior face of the masonry wall in a direction toward an interior face of the masonry wall. The method may also include diverting the moisture to drain generally vertically down one or more interior hollow cores of the masonry block. Optionally, the masonry block may include one or more moisture drainage elements formed in the top surface of the masonry block. Each of the moisture drainage elements may include at least one downwardly slanted surface extending toward an adjacent one of the interior hollow cores of the masonry block when the blocks are assembled into a wall structure. The method may further include directing the moisture that drained down the hollow core of the masonry block to exit at a location that is exterior to the exterior face of the masonry wall.

Some of the embodiments described herein may optionally provide one or more of the following advantages. First, some embodiments of the masonry units can be used to form a wall that provides an improved resistance to moisture penetration by providing a drainage path for water that might otherwise advance to the interior face of the wall. For example, the masonry units can provide a drainage path that directs the migrating water through interior hollow cores of the respective masonry units before the migrating water can reach the interior face of the wall.

Second, in some embodiments, the masonry units can include one or more moisture drainage elements along a top surface of each masonry unit, yet the moisture drainage elements can be entirely concealed from view with the masonry units are assembled into a wall system. For example, the moisture drainage elements can be arranged along the top surface of each masonry unit while also being spaced inwardly from the outer perimeter of the top surface. Accordingly, in particular embodiments, the moisture drainage elements can be positioned to effectively divert water or other liquids through the hollow interior cores even though the moisture drainage elements are nonviewable from an exterior face of the wall and do not detract from the outer appearance of the wall.

Third, some embodiments of the masonry units can incorporate the moisture drainage elements even though the overall size and shape of each masonry unit is consistent with a standard unit size and form factor. As such, the masonry units can be readily installed by a worker without necessarily requiring specialized installation techniques other than those commonly used in the industry.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
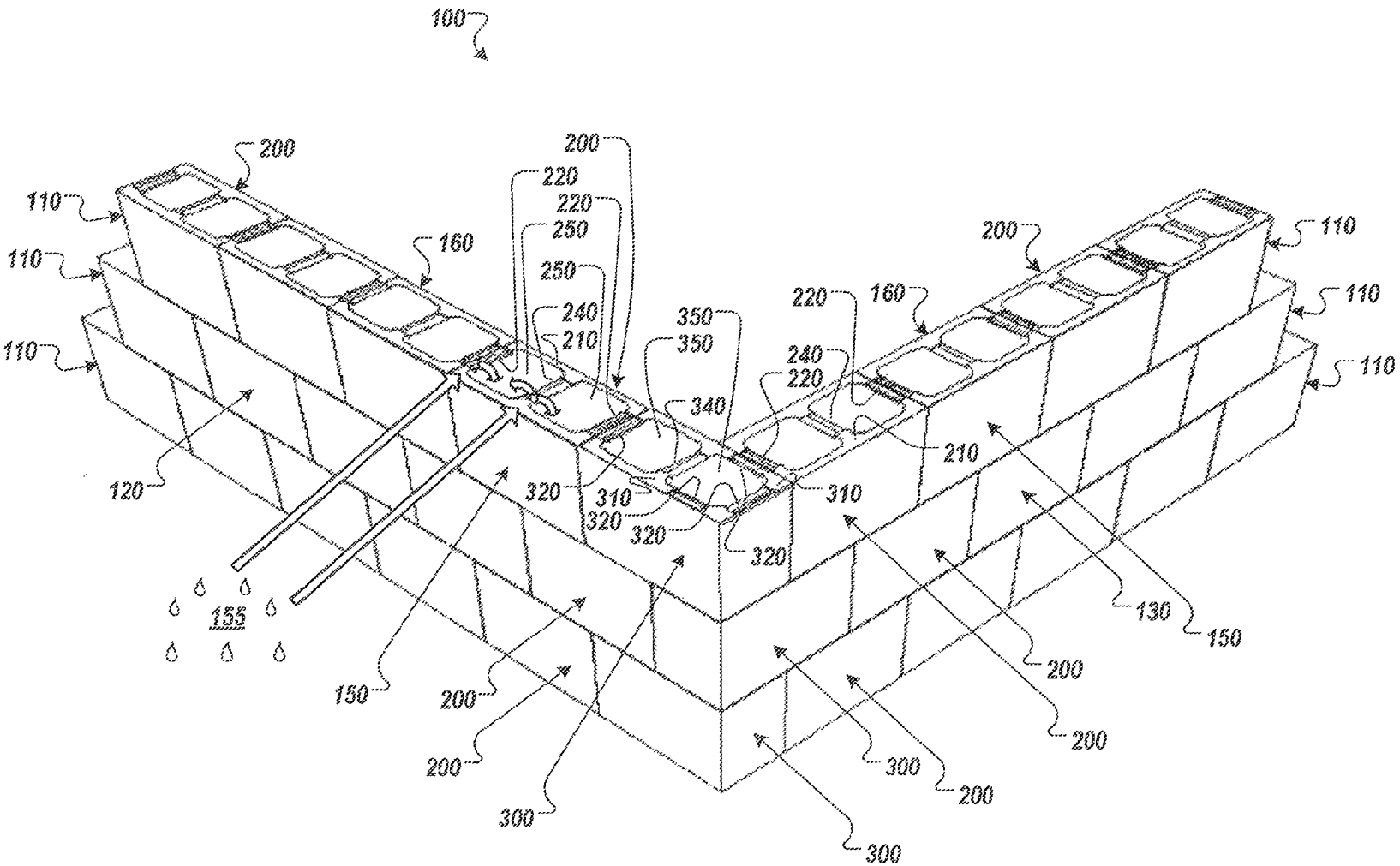
FIG. 1 is perspective view of a wall system, in accordance with some embodiments.

Referring to FIG. 1, a wall system 100 can be formed from an assembly of masonry units that provide a number of moisture drainage elements. In this embodiment, the masonry blocks 200 and 300 include a set of moisture drainage elements 220, 240, 320, and 340 extending along the top surfaces of the respective units 200 and 300. The moisture drainage elements 220, 240, 320, and 340 can be formed on each block 200 and 300 in one or more rows 110 of the wall system 100. In this embodiment, the wall system 100 includes a first masonry wall 120 and a second masonry wall 130 that join at a corner 140. In such circumstances, a first type of masonry blocks 200 can be used along the longitudinal length of the walls 120 and 130 while a second type of masonry blocks 300 (referred to herein as "corner masonry blocks") are installed at each corner 140 of the wall system 100. As described in more detail below, in some embodiments, the corner masonry blocks 300 may include an additional quantity of moisture drainage elements 320 compared to the first masonry blocks 200.

In some embodiments, each of the masonry blocks described herein can be molded or otherwise formed as a unitary structure comprising a concrete mix material and, optionally, an integral water repellent admixture. Also, in the embodiment depicted in FIG. 1, each of the masonry blocks 200 and 300 can be secured to the adjacent blocks in the wall using mortar material, such as a mortal material that includes an integral water repellent admixture. As such, the wall system 100 can provide structural support for a building or other structure. In some embodiments, the wall system 100 can be installed along the rim of a building and over a foundation (not shown in FIG. 1) with "weeps" and drip edges (not shown in FIG. 1) along the base of the wall system 100 to allow moisture that is directed vertically through hollow cores 250 and 350 of the masonry blocks 200 and 300 to thereafter drain outwardly of an exterior face 150 of the wall system 100.

Briefly, in use, some embodiments of the wall system 100 can be exposed to water or other moisture 155 along the exterior face 150 of the wall system 100. In such circumstances, the moisture 155 can migrate from the exterior face 150 of the wall system 100 in a direction toward an opposite interior face 160 of the wall system 100. For example, the moisture 155 may seep through cracks or porous joints in the mortar between adjacent masonry blocks 200, 300 and move along the top surfaces 210, 310 of the masonry blocks 200, 300 in a direction toward the interior face 160 of the wall system 100. In such embodiments, the moisture drainage elements 220, 240, 320, and 340 positioned along the top surfaces 210, 310 of the masonry blocks 200, 300 can be configured to redirect the moisture 155 such that the moisture 155 drain into the hollow cores 250, 350 of the masonry blocks 200, 300. Preferably, the moisture 155 is drained into the low cores 250, 350 before the moisture 155 is permitted to penetrate the interior face 160 of the wall system. In doing so, the moisture drainage elements 220, 240, 320, and 340 can reduce the likelihood of the moisture 155 seeping into the exterior face 150 and thereafter reaching the interior face 160. Moreover, is particular embodiments, the moisture drainage elements 220, 240, 320, and 340 can achieve this benefit even in some circumstances when other supplemental moisture control techniques (e.g., double wythe walls, sealants or coatings on the wall surface, and the like) are not implemented or not properly executed at the construction site.

Still referring to FIG. 1, some embodiments of the moisture drainage elements 220, 240, 320, and 340 of the masonry blocks 200, 300 can have a shape and location the improves the moisture drainage capabilities while continuing to provide the masonry blocks 200, 300 with an overall standard size and form factor. Accordingly, in particular embodiments, the masonry blocks 200, 300 can be assembled together to form the wall system 110 in a manner that does not necessarily require specialized installation techniques other than those commonly used in the construction industry. For example, as shown in this embodiment in FIG. 1, each of the masonry blocks 200, 300 can include a rectangular shape with two hollow vertical cores 250, 350 that are separated by a central web portion. This rectangular shape of the masonry blocks 200, 300 permits each row 110 of the wall system 100 to be arranged in a "brick pattern" relative the adjacent row 100 while the hollow cores 250, 350 of the masonry blocks 200, 300 in each row 110 are in fluid communication with the corresponding hollow cores 250, 350 of the masonry blocks 200, 300 in the adjacent row 110. Further, in this embodiment shown in FIG. 1, the moisture drainage elements 220, 240, 320, and 340 can be arranged on the masonry blocks 200, 300 such that the moisture drainage elements 220, 240, 320, and 340 are concealed from view when the wall system is constructed. As described in more detail below, each of the masonry blocks 200, 300 can be formed such that the outer rectangular rim edge of the top surface 250, 350 has a generally continuous height relative to the bottom surface of the block 200, 300. Accordingly, when an upper block 200, 300 is assembled on top of a lower block 200, 300 in the wall system 100, the moisture drainage elements 220, 240, 320, and 340 of the lower block 200, 300 are concealed when viewing the exterior face 150 of the wall system 100.

Figure 2A:
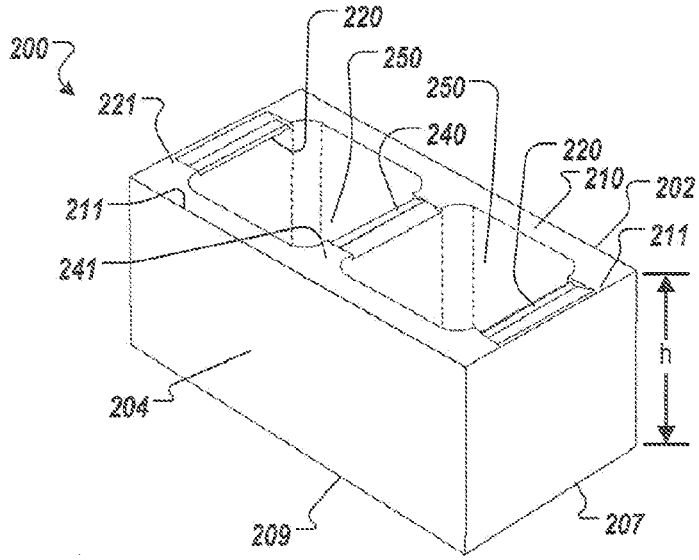
FIGS. 2A-2C show perspective, top, and cross-sectional views (respectively) of an example masonry unit for use in the wall system of FIG. 1.

Referring now to FIGS. 2A-2D, some embodiments of the first type of masonry block 200 may include two of the drainage elements 220 and one drainage element 240. As previously described, the drainage elements 220 and 240 can be formed in the top surface 210 of the masonry block 200. For example, the drainage element 240 is formed in the uppermost face of the central web 241 of the masonry block 200, and the drainage elements 220 are formed in the uppermost face of the end webs 221 of the masonry block 200. Here, the block 200 includes a front wall portion 202 and a rear wall portion 204, and the central web 241 and the end webs 221 extend between the front and rear walls portions 202 and 204 so as to define the pair of interior cores 250. As shown in FIG. 2A, the front wall portion 202, the rear wall portion 204, the central web 241, and the end webs 221 all have a generally uniform height h relative to a bottom surface 207 of the block. In some embodiments, the front wall portion 202, the rear wall portion 204, and the webs 221 and 241 are integrally formed as a unitary structure comprising a concrete material and, optionally, an integral water repellent admixture. As such, the block 200 is a generally rigid masonry unit that is suitable for construction of buildings and other structures.

In this embodiment, the top surface 210 of the block 200 includes outer perimeter 211 that is generally rectangular in shape, and the outer perimeter 211 of the top surface 210 has the generally continuous height h relative to the bottom surface 207. For example, even though the moisture drainage elements 220 and 240 are configured as depressions in particular areas of the webs 221 and 241 in this embodiment, the moisture drainage elements 220 and 240 are spaced inwardly from the outer perimeter 211 to thereby enable the outer perimeter 211 in its entirety to have the generally continuous height h relative to the bottom surface 207. Such a configuration can in some embodiments, permit the blocks 200 to be installed into a wall system 100 (FIG. 1) in a manner that permits the moisture drainage elements 220 and 240 to be conceal from view yet positioned to divert water into the interior cores 250.

Figure 2B:
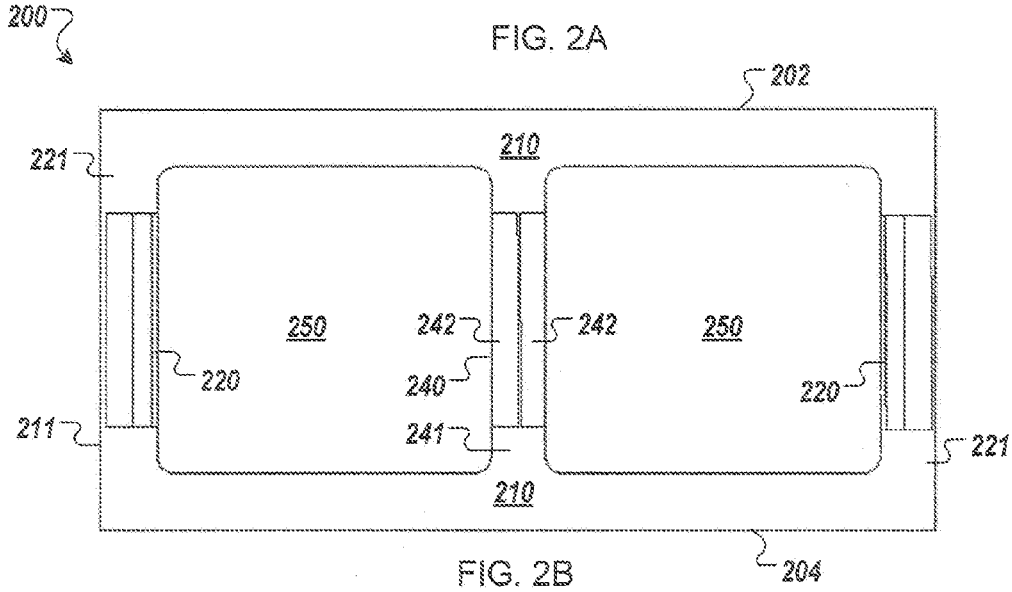

As shown in FIGS. 2A-2B, the top surface 210 of the block 200 extends generally horizontally over the entire front and rear wall portions 202 and 204 and over portions of the webs 221 and 241. In this embodiment, the moisture drainage elements 220 and 240 are formed in the uppermost faces of the webs 221 and 241, so the uppermost face of each web 221 and 241 includes a horizontally extending surface region adjacent to the respective moisture drainage element 220, 240. Thus, even if water or other moisture 155 (FIG. 1) can migrate along a generally horizontal region of the webs 221 and 241, the moisture drainage elements 220 and 240 can divert the water or other moisture 155 before it reaches the opposite ends of the webs 221 and 241.

Figure 2C:
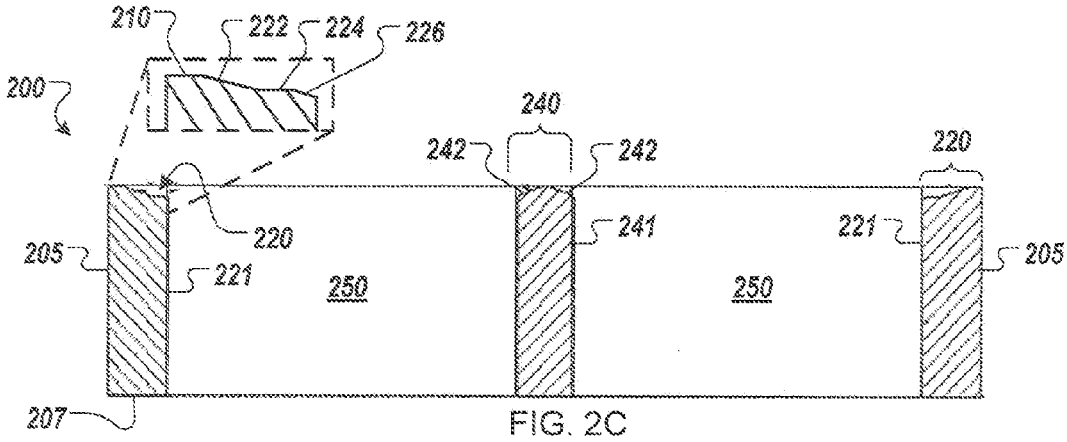

Referring to FIG. 2C, at least some of the drainage elements 220 of the masonry block 200 can include multiple sloped surfaces that extend downwardly toward the adjacent hollow core 250. In this embodiment, the moisture drainage elements 220 positioned along the end webs 241 have a different shape than the moisture drainage element 240 positioned along the central web 241. For example, the drainage element 220 in this embodiment includes is spaced inwardly from the generally horizontal top surface 210 and include a first downwardly sloped surface 222, an intermediate surface 224, and a second downwardly sloped surface 226. The drainage elements 220 are formed such that the first downwardly sloped surface 222 recedes below the plane of the top surface 210 so that the intermediate surface is positioned at a lower height than the top surface 210. In some implementations, the intermediate surface 224 may be substantially parallel to the plane of the top surface 210 (e.g., approximately horizontal), or may be sloped at an angle less than that of the first downwardly sloped surface 222 or the second downwardly sloped surface 226. The second downwardly sloped surface 226 recedes further below the intermediate surface 224, extending from the plateau surface 224 to the hollow core 250. In this embodiment, the downward slope of the first downwardly sloped surface 222 is approximately equal to second downwardly sloped surface 226. As shown in FIG. 2C, the moisture drainage element 220 of one end web 221 is similar in shape to (and a mirror of) the oppositely positioned drainage element 220 of the other end web 221.

Still referring to FIG. 2C, in this embodiment, the drainage element 240 positioned on the central web 241 of the masonry block 200 has a different shape. For example, the drainage element 240 includes two sloped surfaces 242 arranged in a pitched configuration with its peak extending along the lengthwise center of the drainage element 240. The two sloped surfaces extend downwardly away from one another and toward the respective hollow cores 250 on opposite sides of the drainage element 240.

In some implementations, the sloped surfaces 222, 226, and 242 may be oriented at slope angle of about 2-degrees to about 89-degrees from the generally horizontal top surface 210, about 5-degrees to about 60-degrees from the generally horizontal top surface 210, and preferably about 10-degrees to about 30-degrees from the generally horizontal top surface 210. In this embodiment depicted in FIGS. 2A-2C, the slope surfaces 222, 226, and 242 are oriented at a downward slope angle of about 18-degrees from the horizontal. Here, the slope angle of the surfaces 222, 226, and 242 can be selected to be sufficiently great so as to effective divert moisture toward the cores 250 and without being too great so as to overly reduce the thickness and strength of the webs 221 and 241. In this embodiment, the slope angle of the surfaces 222, 226, and 242 are selected to that the total depression from the top surface 210 to the lowermost edge of the moisture drainage element 220, 240 is no greater than 0.5-inches, and preferably about 0.4-inches.

Still referring to FIG. 2C, it should be understood that the bottom surface 207 of the masonry block 207 can also be configured to reduce the likelihood of water or other moisture migrating toward a rear face of the block 200. For example, when the blocks 200 are assembled in a wall system (e.g., wall system 100 in FIG. 1), the blocks 200 in an upper row 110 (FIG. 1) may be positioned above the same type of blocks 200 in a lower row 110. In such circumstances, water or other moisture 115 might migrate in a path along a portion of the bottom surface 207 (FIGS. 2A and 2C) of an upper block 200 in the upper row 115 (FIG. 1) rather than migrating along the top surface 210 of a lower block 200 in the lower row 155. In the embodiments described herein, the bottom surface 207 of each block 200 can include one or more structural or composition features to reduce the likelihood that the water will track along the bottom surface 207 of the upper block 200 along the full path from the front face 202 to the rear face 204 (thereby bypassing the drainage elements 220, 240). For example, the bottom surface 207 of each block 200 can include a 90-degree corner 209 (to the extent reasonable under the manufacturing tolerances) along a rectangular periphery of the bottom surface 207 (including along the lower front corner 209 as shown in FIG. 2A) such that any water that reaches the periphery of the periphery of the bottom surface 207 will be induced to drip down to the lower block 200 below. In addition or in the alternative, the bottom surface 207 of each block 200 can include textured surface elements, such as a non-uniform texture formed during a block molding process or a predetermined pattern of small ribs, grooves, or ridges, that induce any water tracking along the bottom surface to drip down to the lower block 200 below (and thereby migrating to the drainage elements of the lower block 200). In addition or in the alternative, the bottom surface 207 of each block 200 can include a material comprising an integral water repellant admixture (in combination with the concrete mix) to reduce the surface tension along the bottom surface and inhibit water tracking along the bottom surface. Similar features can be implemented on the bottom surfaces of the alternative masonry blocks 300, 360, 400, 500, 560, 600, 700, and 750 described herein.

Figure 2D:
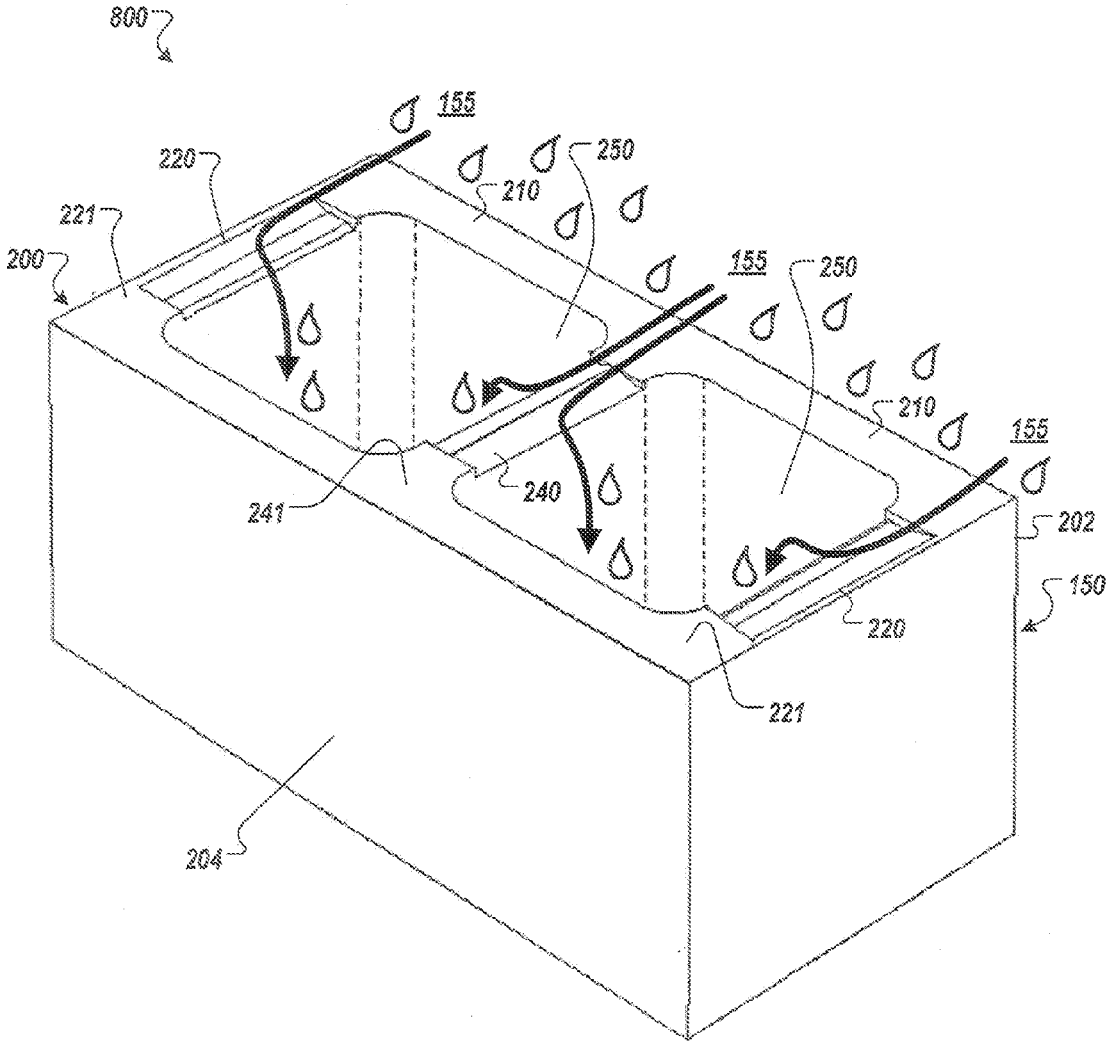
FIG. 2D is a perspective view of an example drainage of moisture along the masonry unit of FIGS. 2A-C.

Referring to now FIG. 2D, the moisture drainage elements 220 and 240 are positioned along the top surface 210 of the masonry block 200 so as to divert water or other moisture 155 toward the interior hollow cores 250 before the moisture 155 penetrates to the rear wall portion 204. When the masonry block 200 is installed in a wall system (refer, for example, to the system in FIG. 1), the front wall portion 202 can be arranged on along the exterior face of the building or other structure such that it may be exposed to water or other moisture 155. In the event that the moisture 155 seeps past the mortar joints or otherwise migrates along the top surface 210 of the block 200, the moisture 155 can be intercepted and diverted by the drainage elements 220 and 240. For example, water or another liquid migrating along the top surface 210 of the block 200 can migrate along only a portion of the webs 221 and 241 before the drainage elements 220 and 240 direct the liquid into the hollow cores 250 by the force of gravity and the slope surfaces 222, 226, and 242 of the drainage elements 220 and 240. As such, in the illustrated example, the moisture drainage elements 220 and 240 can reduce the likelihood of the moisture 155 migrating from the front wall portion 202 of the block and thereafter penetrating the rear wall portion. Moreover, in some circumstances, this beneficial function can be achieved even in wall systems that employ a single wythe wall configuration of the masonry blocks. As described in more detail below, similar redirection and drainage of the moisture 155 can be accomplished by using the alternative masonry blocks 300, 360, 400, 500, 560, 600, 700, and 750.

Figure 3:
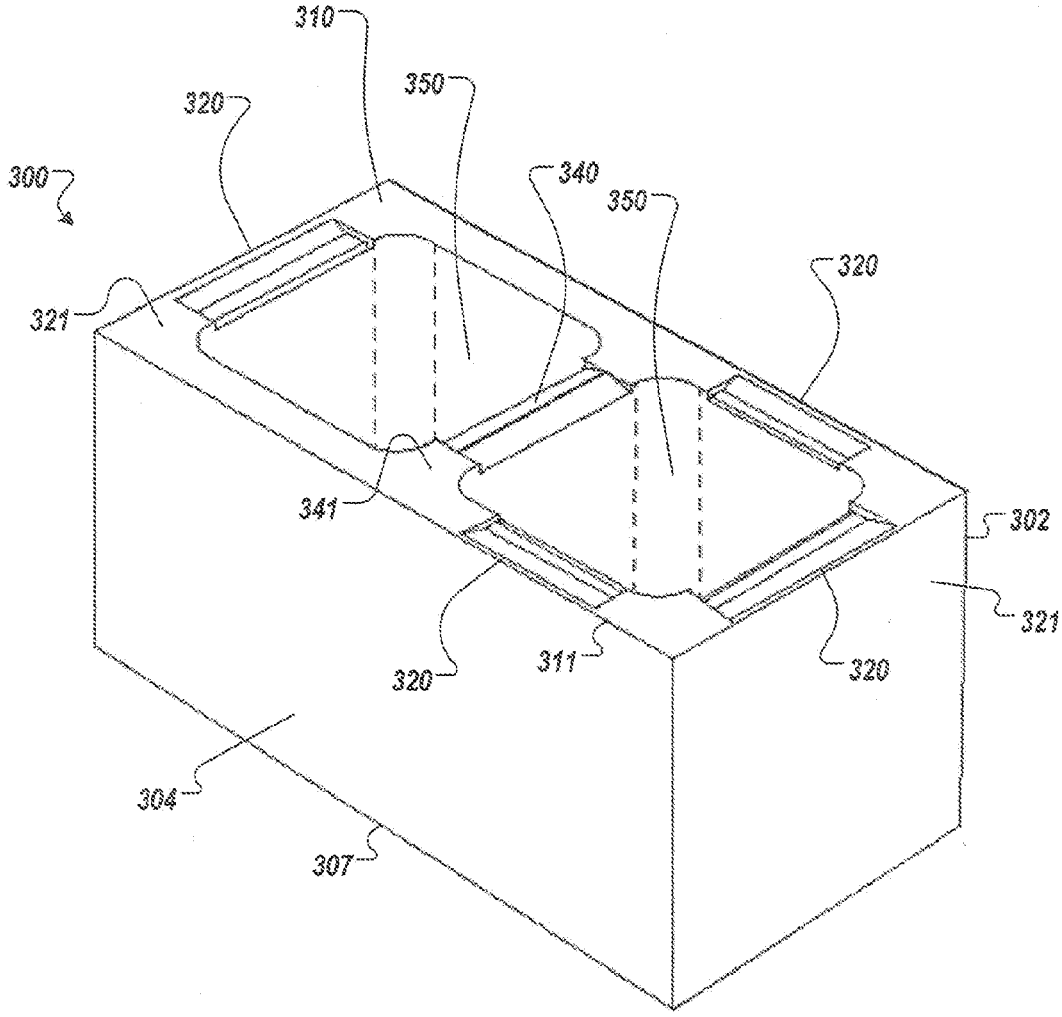
FIG. 3 shows a perspective view of another example masonry unit for use in the wall system of FIG. 1.

Referring now to FIG. 3, some embodiments of corner masonry blocks 300 can be useful for installation at corner junctions of a masonry wall system (e.g., refer to corner 140 of the wall system 100 in FIG. 1). In this embodiment, the corner masonry blocks 300 include moisture drainage elements 320 that are similar in shape and function to the previously described moisture drainage elements 220, and also include a moisture drainage element 340 that is similar in shape and function to the previously described moisture drainage element 240. However, the corner masonry blocks 300 in this embodiment include two additional of moisture drainage elements 320 compared to the first masonry blocks 200 (FIGS. 2A-2D). The location of the drainage elements 320 on the front and rear sides of the block 300 permit the corner masonry blocks 300 to be used to form either left or right corners.

In particular, the masonry block 300 includes two additional drainage elements 320 formed in the top surface 310 of the block over the front wall portion 302 and the rear wall portion 304. As shown in FIG. 1, these additional drainage elements 320 along the front and rear wall portions 302 and 304 are positioned so as to provide the moisture drainage capabilities even when the block 300 is positioned at a corner junction of a wall system (e.g., even when one of the end webs 321 serves as an exterior face of the wall system).

Similar to the masonry block 200 previously described in connection with FIGS. 2A-2D, the corner masonry block 300 includes a front wall portion 302 and a rear wall portion 304, and the central web 341 and the end webs 321 extend between the front and rear walls portions 302 and 304 so as to define the pair of interior cores 350. Also similar to the previously described embodiments, the outer rim perimeter 311 of the top surface 310 is generally rectangular in shape and has a generally continuous height relative to a bottom surface 307 of the block 300. In this embodiment, the front wall portion 302, the rear wall portion 304, and the webs 321 and 341 are integrally formed as a unitary structure comprising a concrete material. As such, the block 300 is a generally rigid masonry unit that is suitable for construction of buildings and other structures.

In some implementations, the additional moisture drainage elements 320 formed on the masonry block 300 permit the masonry block to be used as multipurpose block. For example, the masonry block 300 may be used as a corner block at a corner junction 140 (refer, for example, to FIG. 1) in a wall system. Also, the masonry block 300 may be used to for a "T" or "X" shaped intersection of different wall sections in a wall system. In yet another example, the masonry block 300 may be installed along the longitudinal length of the rows 110 in a wall system (e.g., as an alternative to using the masonry block 200).

Figure 4A:
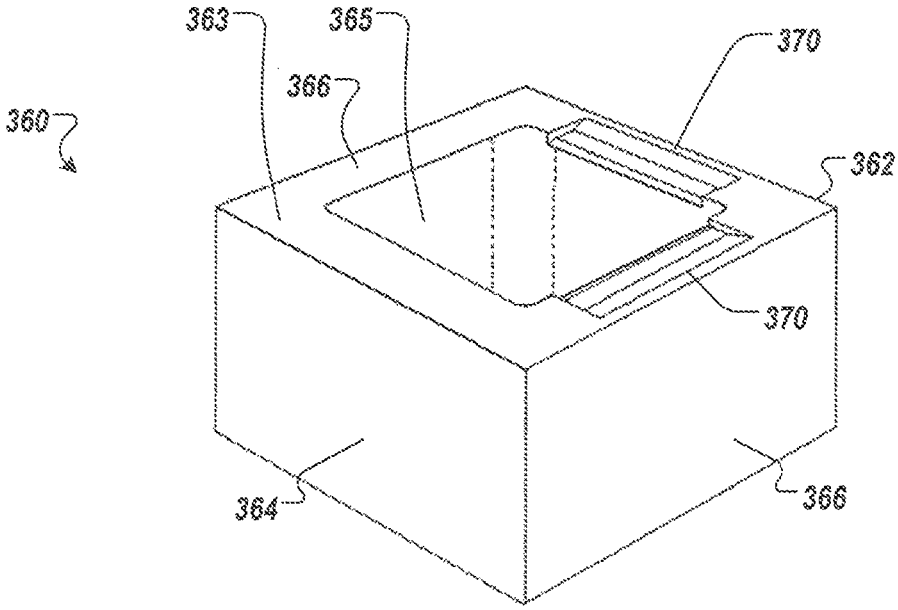
FIGS. 4A-4B show perspective and top views (respectively) of a masonry unit, in accordance with some alternative embodiments.
Figure 4B:
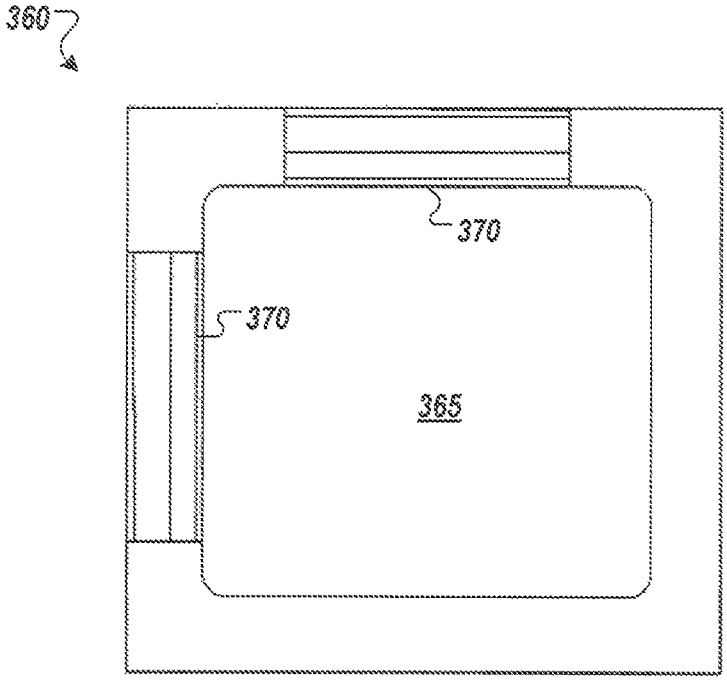

Referring now to FIGS. 4A-4B, some alternative embodiments of a masonry block 360 may be suitable for use as an end block in a wall system. The masonry block 360 in this embodiment can include a single hollow core 365 that is surrounded by a front wall portion 362, a rear wall portion 364, and a pair of end webs 366. Also similar to the previously described embodiments, the end block 360 includes a generally horizontal top surface 363 and an outer rim perimeter of the top surface 363 has a generally continuous height relative to a bottom surface of the block 360.

In this embodiment, the block 360 includes moisture drainage elements 370 along the top surface 363 over two adjacent sides of the masonry block 360. For example, the moisture drainage elements 370 can be formed in an uppermost face of the front wall portion 362 and in an uppermost face of an adjacent end web 366. In this embodiment, the moisture drainage elements 370 are similar in shape and function to the previously described moisture drainage elements 220 (FIGS. 2A-2D). Here, these drainage elements 370 can be arranged to provide the moisture drainage capabilities when the end block 360 is positioned, for example, at a corner junction of a wall system.

Figure 5A:
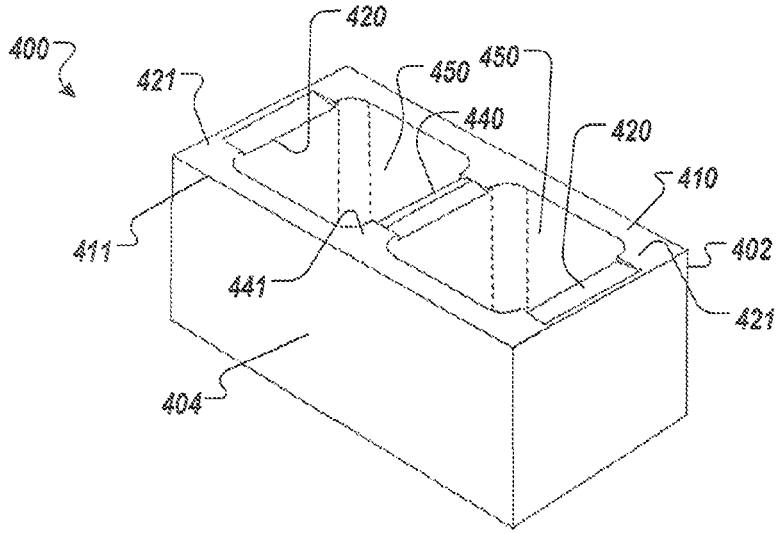
FIGS. 5A-5C show perspective, top, and cross-sectional views (respectively) of another masonry unit, in accordance with some alternative embodiments.
Figure 5B:
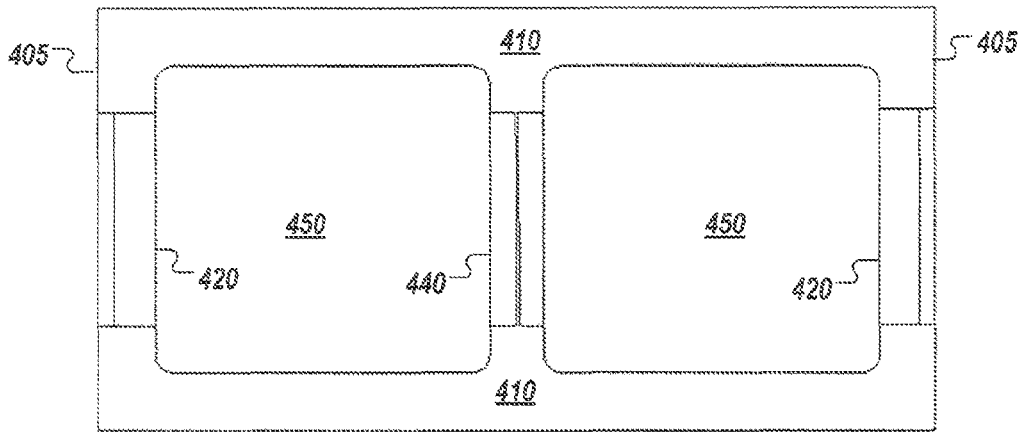
Figure 5C:
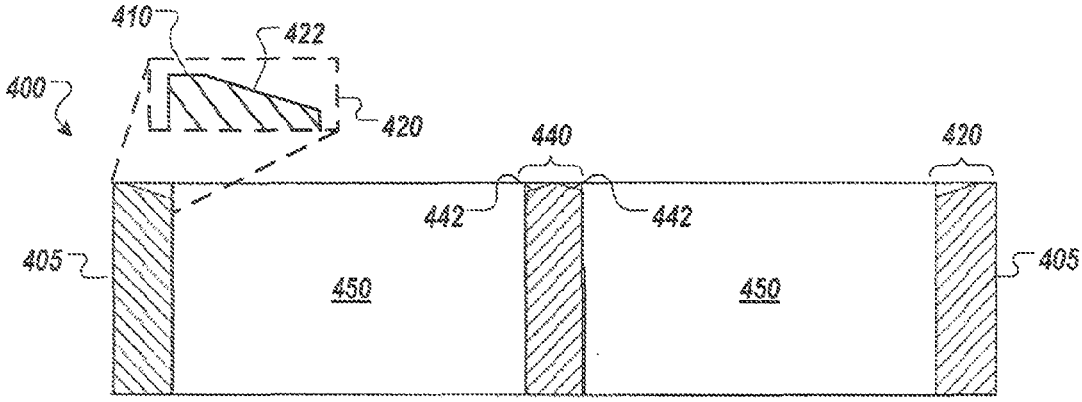

Referring now to FIGS. 5A-5C, some alternative embodiments a masonry block 400 may have a shape and a function similar to the previously described masonry block 200 (FIGS. 2A-2D), except that the moisture drainage elements 420, 440 of the depicted masonry block 400 have a different shape. Similar to the masonry block 200 previously described in connection with FIGS. 2A-2D, the corner masonry block 400 a front wall portion 402 and a rear wall portion 404, and the central web 441 and the end webs 421 extend between the front and rear walls portions 402 and 404 so as to define the pair of interior cores 450. Also similar to the previously described embodiments, the outer rim perimeter 411 of the top surface 410 is generally rectangular in shape and has a generally continuous height relative to a bottom surface 307 of the block 300. In this embodiment, the front wall portion 402, the rear wall portion 404, and web 421 and 441 are integrally formed as a unitary structure comprising a concrete material. As such, the block 400 is a generally rigid masonry unit that is suitable for construction of buildings and other structures.

In this embodiment, the masonry block 400 includes two drainage elements 420 having a single slanted surface 422, and one drainage element 440 having a pair of downwardly slanted surfaces 442. Similar to previously described embodiments, the drainage elements 420 and 440 are formed in the top surface 410 of the masonry block 400. The drainage element 440 is formed along a portion of the central web 441 of the masonry block 400, and the drainage elements 420 are formed along portions of the end webs 421 of the masonry block 400.

As shown in FIG. 5C, at least some of the drainage elements 420 of the masonry block 400 can a single sloped surface that extend downwardly toward the adjacent hollow core 450. In this embodiment, the moisture drainage elements 420 positioned along the end webs 441 have a different shape than the moisture drainage element 440 positioned along the central web 441. For example, the drainage element 420 in this embodiment includes is spaced inwardly from the generally horizontal top surface 410 and includes a single downwardly sloped surface 422 that extends to the edge defining the hollow core 450. As shown in FIG. 5C, the moisture drainage element 420 of one end web 421 is similar in shape to (and a mirror of) the oppositely positioned drainage element 420 of the other end web 421.

Still referring to FIG. 5C, in this embodiment, the drainage element 440 positioned on the central web 441 of the masonry block 400 has a different shape. For example, the drainage element 440 includes two sloped surfaces 442 arranged in a pitched configuration with its peak extending along the lengthwise center of the drainage element 440. The two sloped surfaces extend downwardly away from one another and toward the respective hollow cores 450 on opposite sides of the drainage element 440.

In some implementations, the sloped surfaces 422 and 442 may be oriented at slope angle of about 2-degrees to about 89-degrees from the generally horizontal top surface 410, about 5-degrees to about 60-degrees from the generally horizontal top surface 410, and preferably about 10-degrees to about 30-degrees from the generally horizontal top surface 410. In this embodiment depicted in FIGS. 5A-5C, the slope surfaces 422 and 442 are oriented at a downward slope angle of about 18-degrees from the horizontal. In this embodiment, the slope angle of the surfaces 422 and 442 are selected to that the total depression from the top surface 410 to the lowermost edge of the moisture drainage element 420, 440 is no greater than 0.5 inches, and preferably no greater than about 0.4 inches. As previously described, the masonry blocks 400 can be used in a wall system (refer, for example, to system 100 in FIG. 1) so as to provide moisture drainage capabilities similar to those described in connection with the previously described masonry block 200 in FIG. 2D.

Figure 6:
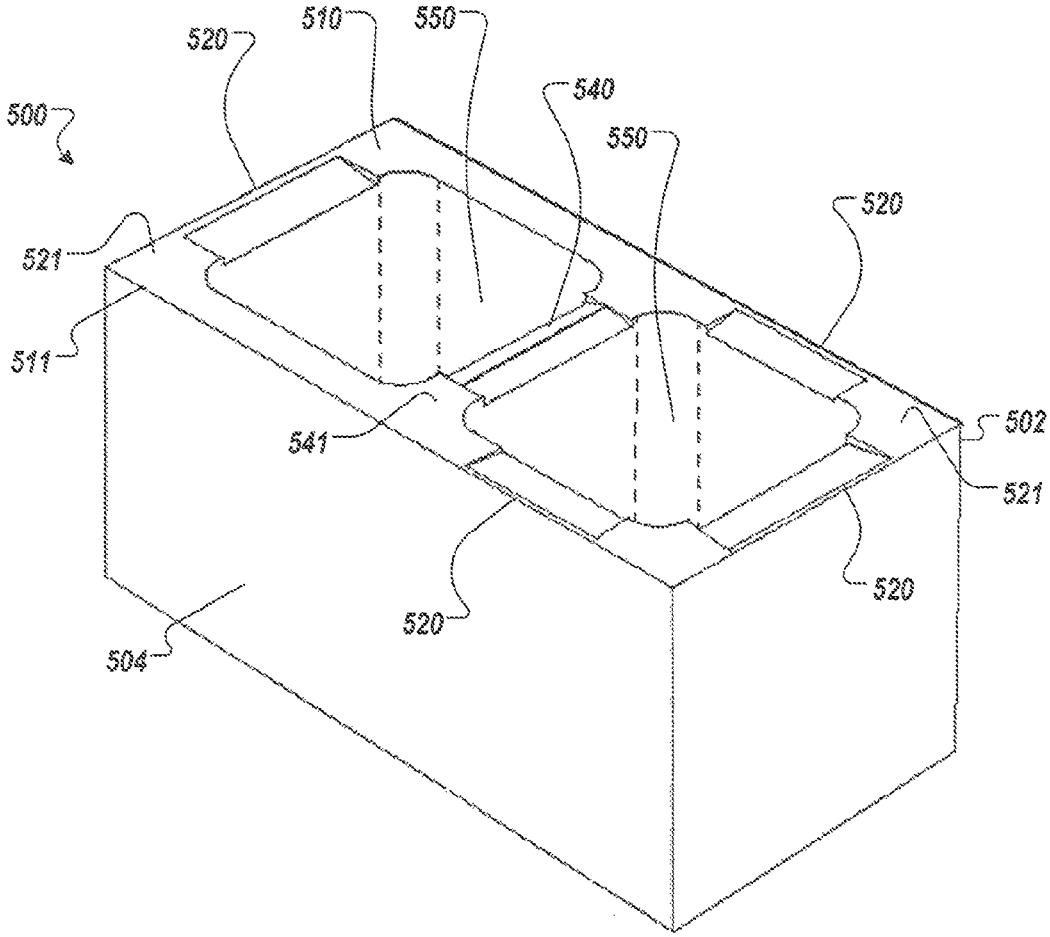
FIG. 6 shows a perspective view of a masonry unit, in accordance with some alternative embodiments.

Referring now to FIG. 6, some embodiments of a corner masonry block 500 can be useful for installation at corner junctions of a masonry wall system (e.g., refer to corner 140 of the wall system 100 in FIG. 1). In this embodiment, the corner masonry block 500 includes moisture drainage elements 520 that are similar in shape and function to the previously described moisture drainage elements 420 (FIGS. 5A-5C), and also includes a moisture drainage element 540 that is similar in shape and function to the previously described moisture drainage element 440 (FIGS. 5A-5C). However, the corner masonry block 500 in this embodiment include two additional of moisture drainage elements 520 compared to the previously described masonry block 400 (FIGS. 5A-5C).

In particular, the masonry block 500 includes two additional drainage elements 520 formed in the top surface 510 of the block over the front wall portion 502 and the rear wall portion 504. As previously described, these additional drainage elements 520 along the front and rear wall portions 502 and 504 are positioned so as to provide the moisture drainage capabilities even when the block 500 is positioned at a corner junction of a wall system (e.g., even when one of the end webs 521 serves as an exterior face of the wall system).

Similar to the masonry block 400 previously described in connection with FIGS. 5A-5C, the corner masonry block 500 includes a front wall portion 502 and a rear wall portion 504, and the central web 541 and the end webs 521 extend between the front and rear walls portions 502 and 504 so as to define the pair of interior cores 550. Also similar to the previously described embodiments, the outer rim perimeter 511 of the top surface 510 is generally rectangular in shape and has a generally continuous height relative to a bottom surface of the block 500. In this embodiment, the front wall portion 502, the rear wall portion 504, and the webs 521 and 541 are integrally formed as a unitary structure comprising a concrete material. As such, the block 500 is a generally rigid masonry unit that is suitable for construction of buildings and other structures.

In some implementations, the additional moisture drainage elements 520 formed on the masonry block 500 permit the masonry block to be used as multipurpose block. For example, the masonry block 500 may be used as a corner block at a corner junction in a wall system (e.g., at corner junction 140 shown in FIG. 1). Also, the masonry block 500 may be used to for a "T" or "X" shaped intersection of different wall sections in a wall system. In yet another example, the masonry block 500 may be installed along the longitudinal length of the rows in a wall system (e.g., as an alternative to using the masonry block 200 or 400).

Figure 7:
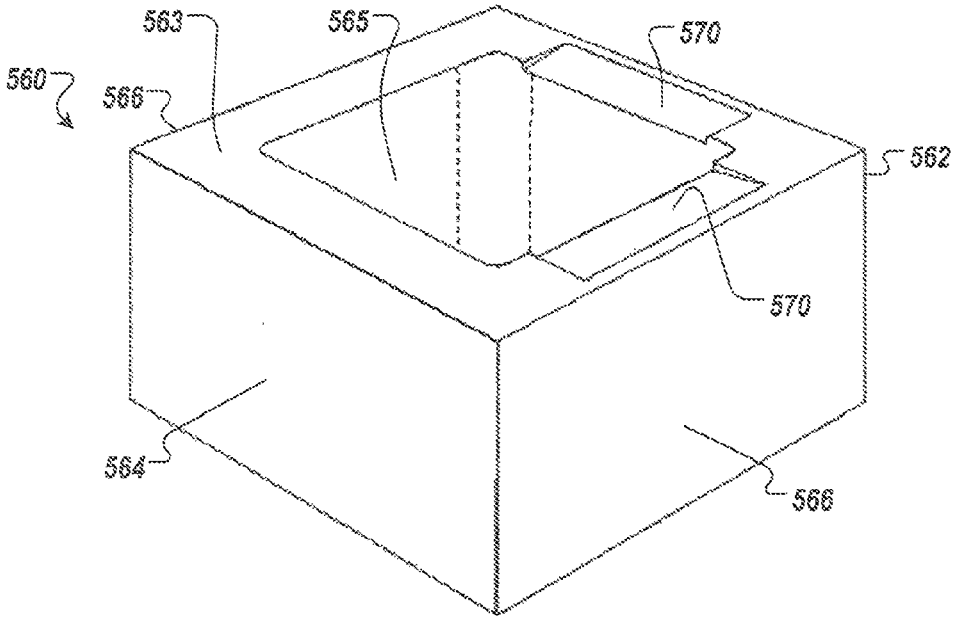
FIG. 7 shows a perspective view of yet another masonry unit, in accordance with some alternative embodiments.

Referring now to FIG. 7, some alternative embodiments of a masonry block 560 may be suitable for use as an end block in a wall system. The masonry block 560 in this embodiment can include a single hollow core 565 that is surrounded by a front wall portion 562, a rear wall portion 564, and a pair of end webs 566. Also similar to the previously described embodiments, the end block 560 includes a generally horizontal top surface 563 and an outer rim perimeter of the top surface 563 has a generally continuous height relative to a bottom surface of the block 560.

In this embodiment, the block 560 includes moisture drainage elements 570 along the top surface 563 over two adjacent sides of the masonry block 560. For example, the moisture drainage elements 570 can be formed in an uppermost face of the front wall portion 562 and in an uppermost face of an adjacent end web 566. In this embodiment, the moisture drainage elements 570 are similar in shape and function to the previously described moisture drainage elements 420 (FIGS. 5A-5C). Here, these drainage elements 570 can be arranged to provide the moisture drainage capabilities when the end block 560 is positioned, for example, at a corner junction of a wall system.

Figure 8A:
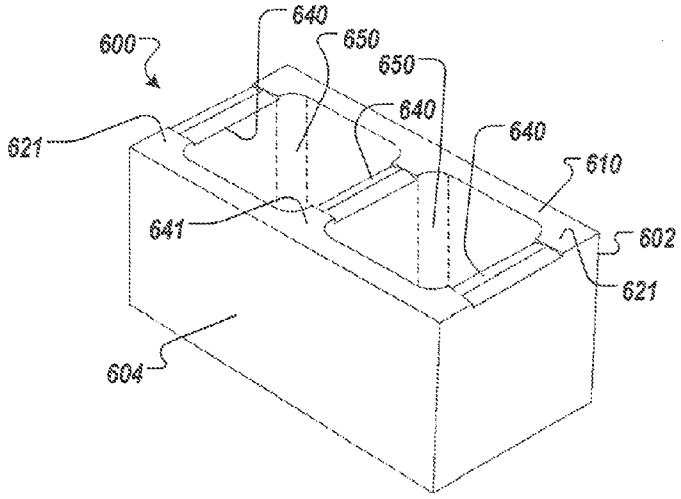
FIGS. 8A-8C show perspective, top, and cross-sectional views (respectively) of an example masonry unit, in accordance with some alternative embodiments.
Figure 8B:
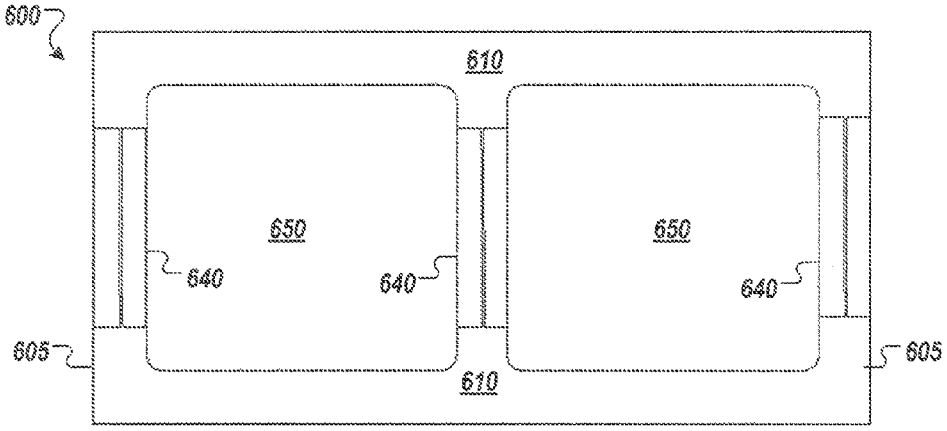
Figure 8C:
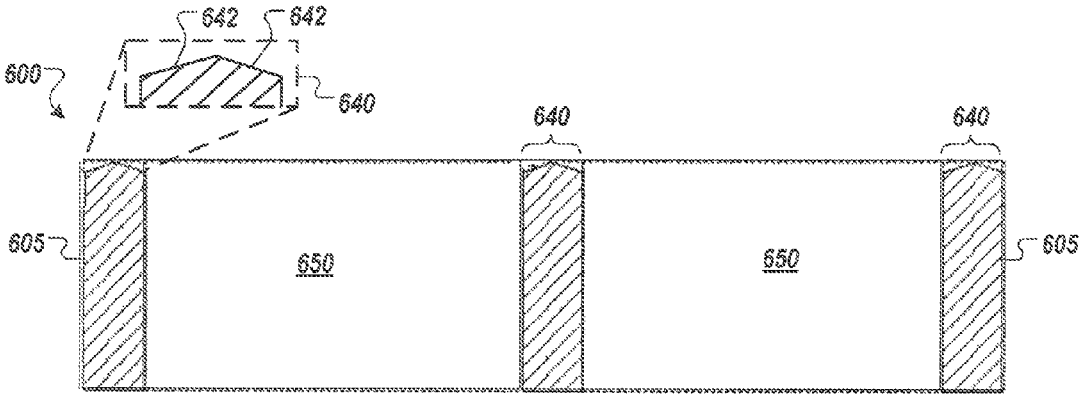

Referring now to FIGS. 8A-8C, some alternative embodiments a masonry block 600 may have a shape and a function similar to the previously described masonry block 200 (FIGS. 2A-2D), except that the moisture drainage elements 640 of the depicted masonry block 600 have a different shape. Similar to the masonry block 200 previously described in connection with FIGS. 2A-2D, the corner masonry block 600 a front wall portion 602 and a rear wall portion 604, and the central web 641 and the end webs 621 extend between the front and rear walls portions 602 and 604 so as to define the pair of interior cores 650. In this embodiment, the front wall portion 602, the rear wall portion 604, and web 621 and 641 are integrally formed as a unitary structure comprising a concrete material. As such, the block 600 is a generally rigid masonry unit that is suitable for construction of buildings and other structures.

In this embodiment, the masonry block 400 includes three drainage elements 640 having a substantially similar shape that are formed along portions of the end webs 621 and the central web 641. For example, the drainage elements 640 may have a substantially similar shape and function as the centrally positioned drainage element 240 depicted FIGS. 2A-2D.

As shown in FIG. 8C, the drainage elements 640 each include two sloped surfaces 642 (FIG. 8C) arranged in a pitched configuration with their peaks extending along the lengthwise centers of the drainage elements 640 and sloping downward toward each side of the respective web 621, 641. In some implementations, the sloped surfaces 642 may be oriented at downward slope angle of about 2-degrees to about 89-degrees from the generally horizontal top surface 610, about 5-degrees to about 60-degrees from the generally horizontal top surface 610, and preferably about 10-degrees to about 30-degrees from the generally horizontal top surface 610. In this embodiment depicted in FIGS. 8A-8C, the slope surfaces 642 are oriented at a downward slope angle of about 18-degrees from the horizontal. As previously described, the masonry blocks 600 can be used in a wall system (refer, for example, to system 100 in FIG. 1) so as to provide moisture drainage capabilities similar to those described in connection with the previously described masonry block 200 in FIG. 2D.

Figure 9:
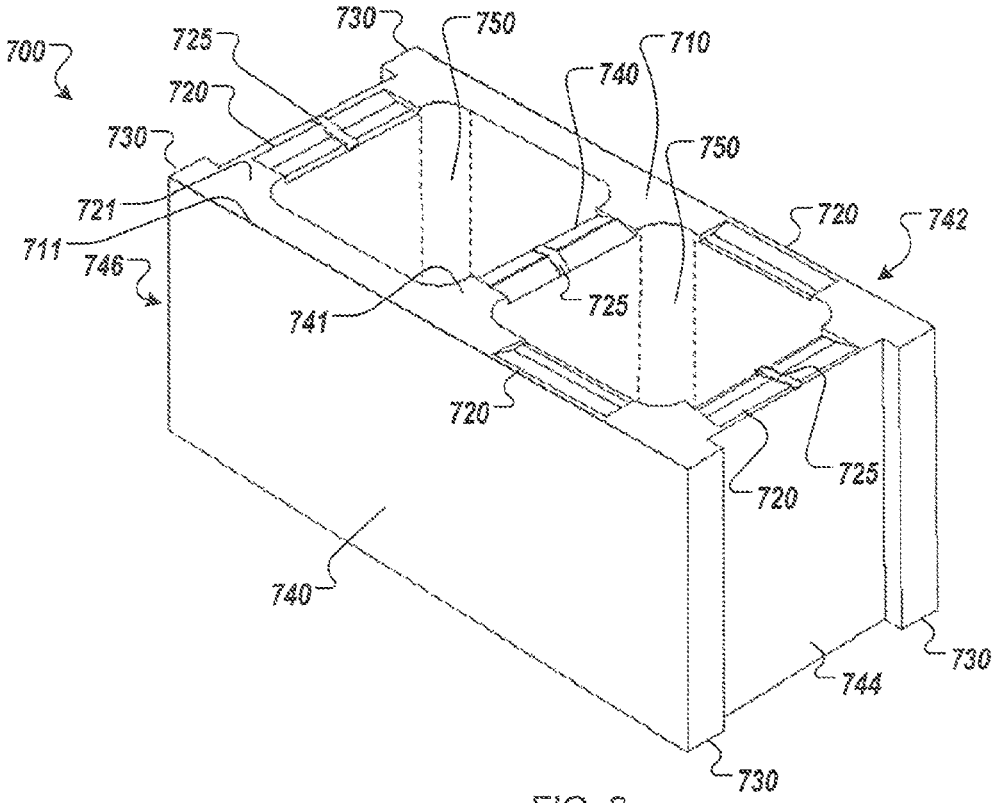
FIG. 9 shows a perspective view of a masonry unit, in accordance with some alternative embodiments.
Figure 10:
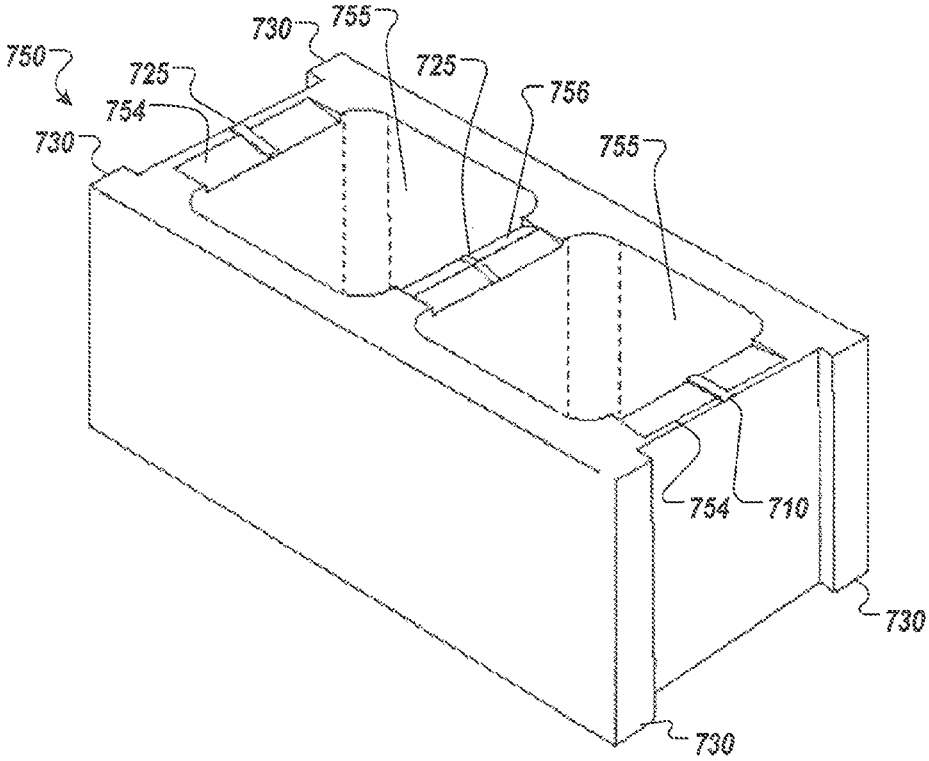
FIG. 10 shows a perspective view of another masonry unit, in accordance with some alternative embodiments.

Referring now to FIGS. 9-10, some embodiments of a masonry block may be formed with core bar marks 725 that extend across one or more the moisture drainage elements. The core bar marks 725 can be a byproduct of the block forming process, and thus can be readily implemented any embodiments of the masonry blocks 200 300, 360, 400, 500, 560, 600, 700, and 750 described herein (already depicted on the masonry blocks 700 and 750 herein). Additionally, some embodiments of the masonry block can include end extensions 730 that protrude outwardly and generally perpendicularly to the end webs 721 of the block 700. These end extensions 730 can be useful in particular construction applications, and thus can be readily implemented any embodiments of the masonry blocks 200 300, 360, 400, 500, 560, 600, 700, and 750 described herein (already depicted on the masonry blocks 700 and 750 herein).

As shown in FIG. 9, some embodiments of a corner masonry block 700 can be include core bar marks 725, end extensions 730 or both. In this embodiment, the corner masonry blocks 700 include moisture drainage elements 720 that are similar in shape and function to the previously described moisture drainage elements 320 (FIG. 3), and also include a moisture drainage element 740 that is similar in shape and function to the previously described moisture drainage element 340 (FIG. 3). Similar to the masonry block 200 previously described in connection with FIG. 3, the masonry block 700 includes a front wall portion 702 and a rear wall portion 704, and the central web 741 and the end webs 721 extend between the front and rear walls portions 702 and 704 so as to define the pair of interior cores 750. Also similar to the previously described embodiments, the outer rim perimeter 711 of the top surface 710 is generally rectangular in shape and has a generally continuous height relative to a bottom surface of the block 700. However, the masonry block 700 in this embodiment includes core bar marks 725 that extend across a plurality of the drainage elements 720 and 740. In particular, the core bar marks 725 can be formed as a byproduct from the block forming process, and the location of the core bar marks 725 can be selected so as to serve as portions of the drainage elements 720, 740 on the webs 721, 741. The core bar marks 725 can protrude above the slanted surfaces of the drainage elements 720, 740 and can be generally level with the top surface 710 of the masonry block 700. In use, this configuration for the core bar marks 725 can enhance the water diversion capabilities of the drainage elements 720 and 740.

As shown in FIG. 10, other embodiments of a masonry block 750 can be include core bar marks 725, end extensions 730 or both. In this embodiment, the masonry block 750 include moisture drainage elements 754 that are similar in shape and function to the previously described moisture drainage elements 420 (FIG. 5A), and also include a moisture drainage element 756 that is similar in shape and function to the previously described moisture drainage element 440 (FIG. 5A). However, the masonry block 750 in this embodiment includes core bar marks 725 that extend across a plurality of the drainage elements 754 and 756. In particular, the core bar marks 725 can be formed as a byproduct from the block forming process, and the location of the core bar marks 725 can be selected so as to serve as portions of the drainage elements 754, 756 on the webs. The core bar marks 725 can protrude above the slanted surfaces of the drainage elements 754, 756 and can be generally level with the top surface 710 of the masonry block 700. As previously described, this configuration for the core bar marks 725 can enhance the water diversion capabilities of the drainage elements 754, 756. Additionally, the masonry block 750 can include end extensions 730 that protrude outwardly and generally perpendicularly to the end webs of the block 750.

A number of different embodiments of masonry blocks have been described herein. Some or all of these embodiments can be used to implement methods of controlling moisture penetration through a masonry wall.

Figure 11:
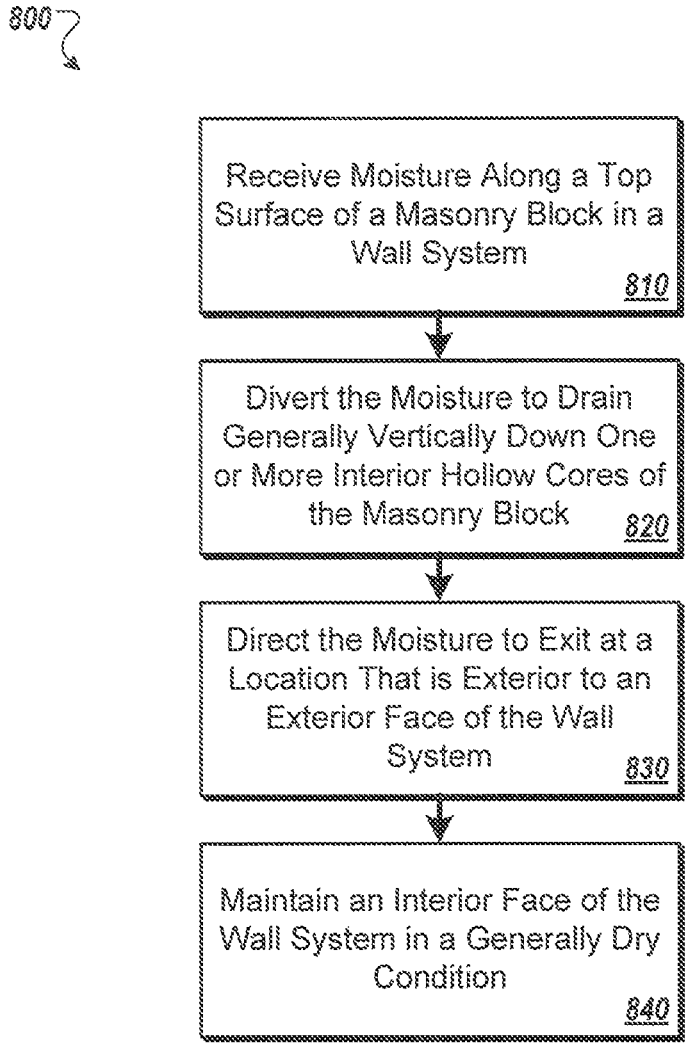
FIG. 11 is a flow diagram of an example process for diverting the flow of moisture across a masonry unit.

For example, referring to FIG. 11, a process 800 for controlling moisture penetration through a masonry wall can include a number of operations perform by a masonry block, such as any embodiment of the masonry blocks 200 300, 360, 400, 500, 560, 600, 700, and 750 described herein. The process 800 may include the operation 810 of receiving moisture along a top surface of a masonry block in a masonry wall. For example, the moisture may advance along the top surface of the masonry block from an exterior face of the masonry wall in a direction toward an interior face of the masonry wall.

In some embodiments, the process 800 may also include the operation 820 of diverting the moisture to drain generally vertically down one or more interior hollow cores of the masonry block. This operation 810 can be accomplished, for example, using one or more of the moisture drainage elements previously described in any of the aforementioned embodiments of the masonry blocks 200 300, 360, 400, 500, 560, 600, 700, and 750. For example, the moisture drainage element can be formed in the top surface of the masonry block, and the moisture drainage element can include at least one downwardly slanted surface extending toward an adjacent interior hollow core of defined by the masonry block.

The process 800 may also include the operation 830 of directing the moisture, which has drained down the hollow core of the masonry block, to exit at a location that is exterior to the exterior face of the masonry wall. For example, the wall system can be installed along the rim of a building and over a foundation with a weep system, flashing, drip edges, or a combination thereof installed along the base of the wall system. These structures can guide the moisture to drain outwardly of the exterior face of the wall system.

Still referring to FIG. 11, the process 800 may optionally include the operation of the maintaining an interior face of the wall system in a generally dry condition. As previously described, the masonry blocks used in the wall system can provides an improved resistance to moisture penetration by providing a drainage path for water that might otherwise advance to the interior face of the wall. Because the moisture is drained away from the wall before the moisture penetrates the interior face of the wall system, the masonry blocks can be useful in maintaining the interior face of the wall system in a generally dry condition even when the exterior face of the wall system is saturated with water or other moisture over a period of time.

A number of embodiments of the invention have been described. Nevertheless, it will be understood that various modifications may be made without departing from the spirit and scope of the invention. For example, the aforementioned embodiments of the masonry blocks can be used in a single wythe masonry wall system, or alternatively in a multiwythe masonry wall system. In another example, some embodiments of the masonry blocks described herein can incorporate the moisture drainage elements so as to provide adequate moisture control either without the inclusion of integral water repellent in the masonry unit composition or with the inclusion of integral water repellent masonry unit composition. Also, the aforementioned embodiments can be used in a wall system in combination with flashing, termination bars, weeps, drip edges, vents and other masonry accessories including but not limited to joint reinforcement and movement joints. Furthermore, the aforementioned embodiments can be used in a wall system in combination with full grouting and reinforcement or with partial grouting and reinforcement. In another example, the aforementioned embodiments can be used in a wall system in combination with or without post-applied wall sealants, coatings, air barriers, vapor permeable materials, membranes, or other similar moisture control materials. Moreover, the aforementioned embodiments of the masonry blocks can be used in combination with mortar material that does not contain integral water repellent admixture or with mortar material does contain integral water repellent admixture. Likewise, the aforementioned embodiments of the masonry blocks can be used in combination with masonry grout does not contain a water reducer (whether high range or not) or with masonry grout that does contain a water reducing admixture. Accordingly, other embodiments are within the scope of the following claims.

What is claimed is:

1. A masonry wall system, comprising:

a first row of masonry blocks; and a second row of masonry blocks positioned vertically over the first row of masonry blocks so as to provide vertical wall section having an exterior face and an interior face, wherein each masonry block of the first row of masonry blocks includes a top surface oriented toward the second row of masonry blocks and a bottom surface opposite from the top surface, and wherein each masonry block of the first row of masonry blocks includes at least one moisture drainage element arranged along the top surface of the respective masonry block, the moisture drainage element comprising at least one downwardly slanted surface extending toward an interior hollow core of the respective masonry block, wherein each masonry block of the first row of masonry blocks includes an upper rim perimeter defined by uppermost exterior edges of the top surface of the respective masonry block, and wherein the liquid diversion elements arranged along the top surface of the respective masonry block are spaced inwardly from the upper rim perimeter such that the upper rim perimeter has a generally continuous elevation.

2. The system of claim 1, wherein each masonry block of the first row of masonry blocks includes: a front wall portion, a rear wall portion that is generally parallel to and spaced apart from the front wall portion, and a plurality of web portions extending between the front and rear faces and extending generally perpendicularly to the front and wall portions, wherein said at least one moisture drainage element comprises a respective moisture drainage element arranged along a top surface of each of the plurality of web portions.

3. The system of claim 2, wherein the moisture drainage element arranged along the top surface of at least one respective web portion includes a first downwardly slanted surface, a second downwardly slanted surface spaced apart from the first downwardly slanted surface by a generally horizontal surface region arranged between the first and second downwardly slanted surfaces.

4. The system of claim 1, wherein the at least one downwardly slanted surface of each moisture drainage element is oriented at slope angle of about 10-degrees to about 30-degrees from a horizontal region of the top surface.

5. The system of claim 1, wherein the moisture drainage element is spaced inwardly from the upper rim perimeter of the top surface of the respective masonry block such that the upper rim perimeter of the top surface of the respective masonry block is continuous is a horizontal plane.

6. The system of claim 1, wherein the moisture drainage element is spaced inwardly from the upper rim perimeter the top surface of the respective masonry block such that the entire upper rim perimeter of the top surface of the respective masonry block is defined by four coplanar edges.

7. The system of claim 1, wherein each masonry block of the first row of masonry blocks comprises a concrete mix material and an integral water repellent admixture.

8. The system of claim 1, wherein each masonry block of the second row of masonry blocks includes a bottom surface having at least one of: a 90-degree corner along a rectangular periphery, textured surface elements, and a material comprising an integral water repellant admixture to reduce the surface tension along the bottom surface and inhibit moisture migration along the bottom surface.

9. A masonry unit for use in a wall system, comprising:

a front face having a vertical height;

a rear face having a vertical height that is substantially equal to the vertical height of the front face;

a plurality of web portions extending between the front and rear faces to define one or more interior hollow cores, each of the web portions extending generally perpendicularly to the front and rear faces, and each of the web portions having a vertical height that is substantially equal to the vertical height of the front face;

a liquid diversion element arranged along a top surface of each web portion extending between the front and rear faces, the liquid diversion element comprising at least one downwardly slanted surface extending toward at least one of the interior hollow cores; and an upper rim perimeter defined by uppermost exterior edges of the front face, the rear face, and at least two of the web portions, wherein the liquid diversion elements arranged along the top surfaces of said two web portions are spaced inwardly from the upper rim perimeter such that the upper rim perimeter has a generally continuous elevation.

10. The masonry unit of claim 9, wherein the liquid diversion element arranged along the top surface of at least one respective web portion includes a first downwardly slanted surface, a second downwardly slanted surface spaced apart from the first downwardly slanted surface.

11. The masonry unit of claim 9, wherein the second downwardly slanted surface is separated from the first downwardly slanted surface by a generally horizontal surface region arranged between the first and second downwardly slanted surfaces, wherein the generally horizontal surface region is positioned at a vertical height that is less than the vertical height of said respective web portion.

12. The masonry unit of claim 11, wherein the first and second downwardly slanted surfaces are oriented at slope angle of about 10-degrees to about 30-degrees from a horizontal region of the top surface of the respective web portion.

13. The masonry unit of claim 9, wherein the top surface of each of the web portions includes a horizontally extending surface region adjacent to the respective liquid diversion element arranged along the top surface.

14. The masonry unit of claim 9, wherein the at least one downwardly slanted surface of the liquid diversion element is oriented at about 18-degrees from a horizontal region of the top surface of the respective web portion.

15. The masonry unit of claim 9, wherein the front face comprises a front wall portion of the masonry unit, and the rear face comprises a rear wall portion of the masonry unit, and wherein the plurality of web portions comprise a pair of outer web portions extending between the front and rear faces, and a central interior web portion extending between the front wall portion and the rear wall portion such that a pair of said hollow interior cores are separated by the central interior web, wherein the outer web portions and the central interior web portions are spaced apart from one another and extend generally parallel to one another.

16. The masonry unit of claim 15, further comprising first and second liquid diversion elements arranged along the top surfaces of the outer web portions, and a third liquid diversion element arranged along the top surface of central interior web portion, wherein the first and second liquid diversion elements have a shape that is different from the third liquid diversion element.

17. The masonry unit of claim 16, further comprising a fourth liquid diversion element arranged along a top surface of front wall portion and having at least one downwardly slanted surface extending toward one of the hollow interior cores, and a fifth liquid diversion element arranged along a top surface of rear wall portion and having at least one downwardly slanted surface extending toward the same one of the hollow interior cores.

18. The masonry unit of claim 9, wherein the front face, the rear face, and the plurality of web portions are integrally formed as a unitary structure comprising a concrete material.

19. The masonry unit of claim 9, wherein the front face, the rear face, and the plurality of web portions are integrally formed from a composition comprising comprises a concrete mix material and an integral water repellent admixture.

* * * * *